United States Patent [19]

Beck

[11] 4,234,248

[45] Nov. 18, 1980

[54] HOT ROLL FUSER

[75] Inventor: Christian A. Beck, Ridgefield, Conn.

[73] Assignee: Pitney Bowes Inc., Stamford, Conn.

[21] Appl. No.: 45,169

[22] Filed: Jun. 4, 1979

[51] Int. Cl.[3] ..... G03G 15/00

[52] U.S. Cl. ..... 355/3 FU; 219/216; 219/469; 432/60

[58] Field of Search ..... 355/3 FU; 219/216, 388, 219/469; 432/60

[56] References Cited

U.S. PATENT DOCUMENTS

| | | | |
|---|---|---|---|
| 3,754,819 | 8/1973 | Braun | 355/3 FU |
| 3,874,894 | 4/1975 | Pedersen | 355/3 FU |
| 4,000,957 | 1/1977 | Ruhland | 355/3 FU |
| 4,050,886 | 9/1977 | Moser | 355/3 FU |
| 4,144,835 | 3/1979 | Fukase et al. | 219/216 X |

*Primary Examiner*—R. L. Moses

*Attorney, Agent, or Firm*—Melvin J. Scolnick; William D. Soltow, Jr.; Albert W. Scribner

[57] ABSTRACT

A heated fuser member for use in an electrostatic copying machine formed of a roll structure whose outer surface comprises graphite is disclosed.

9 Claims, 1 Drawing Figure

HOT ROLL FUSER

BACKGROUND OF THE DISCLOSURE

I. Field of the Invention

This invention relates to a heated fuser device as is commonly used in xerographic copying machines, and more particularly to a heated pressure fuser device including an improved heated fuser member.

II. Description of the Prior Art

In a typical xerographic process a photoconductor comprising a photoconductive composition coated on a rigid or flexible substrate is uniformly electrostatically charged in the dark, and then exposed by being illuminated in an image pattern in accordance with graphic material on an original document. The photoconductor becomes discharged in the areas exposed to the illumination, but retains its electrostatic charge in the dark areas, which areas correspond to the graphic material on the original document. The resulting electrostatic latent image is developed by depositing on the photoconductor a finely divided electrostatically attractable developing material (toner). The toner will normally be attracted to those areas on the photoconductor which retain a charge, thereby forming a toner image corresponding to the electrostatic latent image. This visible image of developing material is then transferred to a support surface, such as plain paper or any other suitable substrate, to become the ultimate copy. Any residual developing material remaining on the photoconductor is cleaned and the photoconductor is reused as described above for subsequent copies. The toner image that was transferred to the plain paper is then fixed thereto. Since the developing material is heat fusible, application of sufficient heat to the paper causes the developing material to melt and be fused into the paper so as to be permanently affixed thereto.

One basic approach to fusing in a xerographic copying machine is the use of the so-called hot roll pressure fusing apparatus in which toner particles are melted by the direct contact, under pressure, of a hot surface of a heated fuser roll with the toner particles. However, as the toner particles are heated, they soften and become sticky to the extent that they readily adhere to other surfaces. During a typical fusing operation there is a tendency for part of the heated toner image to stick to the heated fuser roll. The toner which adheres to the fuser roll will, of course, transfer to the next sheet of support material passing through the fuser, thus producing dirty copies. This process is commonly referred to in the printing art as "offset."

In an attempt to avoid the problem of offset during a fusing process, heated fusing rolls were developed either with (1) a thin outer layer of a tetrafluoroethylene resin (e.g. a tetrafluoroethylene resin sold under the trademark "Teflon" by E. I. DuPont de Nemours & Co.) and a silicone oil film, or (2) a thin outer layer of a silicone elastomeric material (silicone rubber) and a silicone oil film. The physical characteristics of the Teflon material or the silicone rubber with the silicone oil film are such that they are repellent to sticky or tacky substances.

Although the use of either of the above-described coated heated fuser rolls in a xerographic copying machine has helped to prevent the offset problem, they do present other disadvantages. For example, both of these types of coatings exhibit only moderate thermal conductivity properties. This creates various temperature gradients across a heated fuser roll, and thus uneven heating of the toner particles with subsequent poor fusing results. Furthermore, these types of coated fuser rolls present numerous problems in the methods for their manufacture. In addition, it is sometimes necessary to use a silicone oil film on these fuser rolls because there is some tendency of these rolls to pick up toner particles during fusing. To constantly apply a silicone oil film on the roll, the copying machine requires a separate oil container, an apparatus to apply the oil to the rolls as well as a metering and control system to maintain the proper amount of fluid on the roll. Thus there is the requirement of elaborate equipment and therefore additional expense to provide the silicone oil film. When silicone rubber is exposed to silicone oil, the silicone rubber can swell and the integrity of the rubber can deteriorate thereby decreasing its effectiveness under the pressures and temperatures normally encountered in pressure fusing systems. Silicone oil applied to the fuser roll can flow onto a silicone rubber coated pressure roll causing the same disadvantage unless the pressure rolls are end capped to prevent exposure of the silicone rubber layer to the oil. However, this precaution results in added expense in the cost of the pressure roll.

SUMMARY OF THE INVENTION

It is therefore an object of the present invention to overcome many of the disadvantages of the hot roll fusers described in the prior art and to provide a hot roll fuser whose outer surface comprises a material which will fix resinous powder images and prevent offset.

It is a further object of the present invention to provide a hot roll fuser that is relatively simple and inexpensive to manufacture as compared to many typical hot roll fusers.

It is a further object of the present invention to provide a hot roll fuser that does not require the supplementary application of a release agent to the heated roll to ensure copy release from the roll.

It is a further object of the present invention to provide a hot roll fuser comprising a material having sufficient thermal conductivity properties to avoid long periods of fuser warmup and uneven temperature gradients along the roll.

It is still a further object of the present invention to provide a hot roll fuser that avoids the need for a separate apparatus to clean the fuser.

The foregoing objects and others are accomplished in accordance with the present invention by providing a heated fuser member for use in an electrostatic copying machine formed of a roll structure whose outer surface comprises graphite.

BRIEF DESCRIPTION OF THE DRAWINGS

For a better understanding of the invention as well as other objects and further features thereof, reference is made to the following detailed disclosure of this invention taken in conjunction with the accompanying drawing wherein the FIGURE is a schematic sectional view of a copier.

DESCRIPTION OF THE PREFERRED EMBODIMENTS

Figure 1:
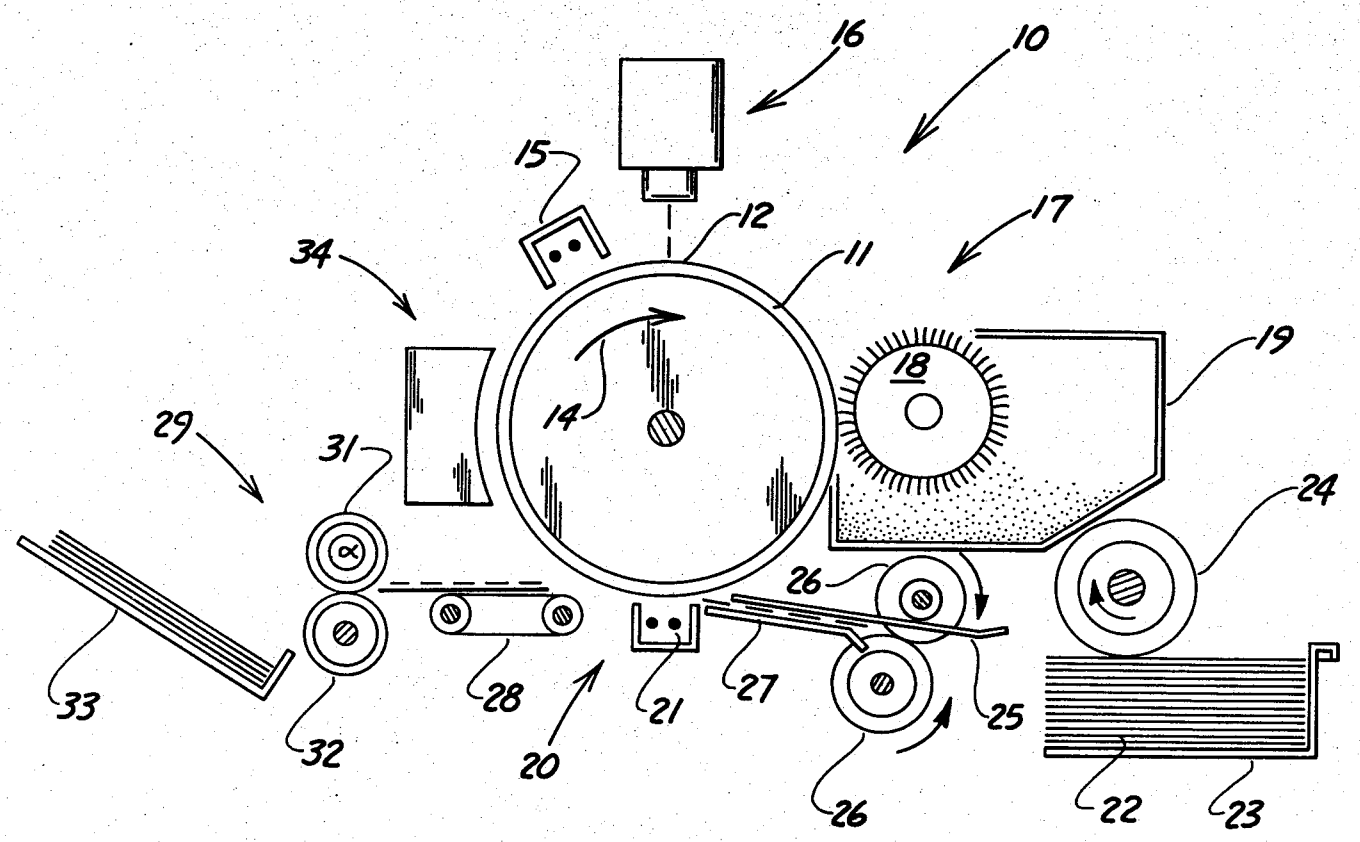

Referring now to the drawings and particularly to the FIGURE, there is shown an electrophotographic copying machine employing a fusing device in which a heated fuser member in accordance with the present invention can be utilized. The various processing stations shown in the FIGURE will be represented in part as blocks and their processing stations will only be briefly described. The particular copying machine illustrated in the FIGURE is merely exemplary as far as the present invention is concerned for a complete understanding of a xerographic process and, in particular, how a fusing apparatus is employed in such a process. A fusing apparatus employing a heated fuser member in accordance with the present invention may be utilized in a wide variety of devices including coated paper copiers and plain paper copiers, and is not necessarily limited to the particular type of copier system shown in the FIGURE.

In the FIGURE, the reference numeral 10 generally designates an electrophotographic copying machine which includes a rotating drum 11 having a photoconductive surface 12 secured around the outer surface of the drum. Any of numerous inorganic or organic photoconductive materials can be employed such as for example, a selenium alloy. Additionally, the photoconductor can be in the form of a belt instead of a drum. As drum 11 rotates in the direction of arrow 14, it passes through the various processing stations disposed around the periphery of the drum.

First, drum 11 rotates a portion of photoconductive surface 12 through a charging apparatus which includes a corona generating device 15 that is positioned closely adjacent the surface of the photoconductor. Corona generating device 15 imparts a uniform electrostatic charge to photoconductor surface 12.

An image of the document to be copied is transmitted to photoconductor surface 12 by the exposure and imaging station generally designated 16. This station could, for example, include a reciprocating carriage that is movably mounted on top of the copying machine cabinet. The carriage would include a transparent platen on which documents are placed faced down for copying. Overlying the platen would be a movable cover connected to one side of the carriage. An operator can raise and lower the cover and thereby place on or remove documents from the platen. A series of lamps would be used to illuminate the original document. By incorporating an optical system comprising mirrors and lenses a light image of the original document to be copied is projected onto the charged portion of photoconductive surface 12. The movement of the carriage and therefore the scanning of the original document is in timed relationship with the movement of rotating drum 11. Thus photoconductive surface 12 is selectively exposed to dissipate the charge thereon and record an electrostatic latent image corresponding to the indicia on the original document.

As drum 11 rotates, the latent image on photoconductive surface 12 is carried past a developer station 17. The developer material used can, for example, be a two component developer which comprises carrier particles having toner particles adhering thereto. The carrier particles are formed of a magnetic material while the toner particles are usually a heat settable plastic. However, a single component toner can also be used. Preferably a magnetic brush developing unit is used in which a rotating magnetic roll 18 picks up toner from a hopper 19 to form a rotating magnetic brush, and carries that toner into contact with the latent image on photoconductive surface 12. The charged or latent image areas of the photoreceptor electrostatically attracts and holds the toner particles, thus developing the latent image.

Transfer station 20 includes a corona transfer charging apparatus 21. In timed relationship with the arrival of the developed image at transfer corona 21, a copy sheet also arrives at transfer station 20. The copy sheet is fed from a supply of sheets 22 stored in removable tray 23. A feed roller 24 feeds the uppermost copy sheet from the supply 22, through paper guide 25 and into the nip of queuing rollers 26. At a predetermined time in the course of a copy cycle, the queuing rollers 26 are actuated to feed the copy sheet along paper guide 27 and into contact with the developed image carried on photoreceptor surface 12. By virtue of the electric charge that is generated by transfer corona 21, toner particles are attracted from photoreceptor surface 12 toward the copy sheet to which they loosely adhere. After transferring the toner powder to the copy sheet, the sheet is stripped away from drum 11 by a suitable apparatus, and advanced by, belt conveyor 28 to fixing station 29.

The copy sheet then passes into fixing station 29 which includes a fusing apparatus in which the toner material now residing on the copy paper is heated to a temperature at which the toner particles melt and are thereby fused into the copy paper so as to form a permanent copy of the original document. An example of a fusing apparatus including a fuser member that forms the basic subject matter of the present invention is illustrated in its operative position in the FIGURE. As shown, the fuser apparatus includes a heated fuser member or roll 31, and a backup member or roll 32. The copy sheet with the toner powder image thereon is interposed between fuser roll 31 and backup roll 32. After the toner image is permanently affixed to the copy sheet, the sheet is separated from the fuser roll and advanced to a catch tray 33 for subsequent removal from the copier by an operator.

In order to remove residual toner particles which adhere to photoconductive surface 12 after the transfer of the powder image to the copy sheet, copying machine 10 is provided with a cleaning system generally designated by reference number 34. The cleaning mechanism can, for example, include a corona generating device and a brush which contacts photoconductive surface 12. First, the remaining toner particles are brought under the influence of the corona generating device to neutralize the electrostatic charge remaining on photoconductive surface 12 and that of the residual toner particles. Thereafter, the neutralized particles are removed from surface 12 by the rotatably mounted brush. After the cleaning operation, a discharge lamp can be used to discharge remaining charges on surface 12 prior to the recharging thereof at corona device 15 for the next copying cycle.

Referring now to the specific subject matter of the present invention a fusing apparatus is provided with a heated fuser member formed of a roll structure whose outer surface comprises graphite. I have found that when a graphite material is used as the outer surface layer of a heated fuser roll that is in pressure contact with a backing member, and fusing is accomplished by passing a support surface, such as paper, with the toner image thereon facing the heated graphite surface between the fuser roll and backup member, offset is prevented. The physical characteristics of the graphite material are such that the graphite defines a surface that has certain release characteristics wherein it is highly repellent to sticky or tacky substances, such as heated toner particles. By employing an outer surface for a heated fuser roll comprising graphite, offset is prevented without the use of a silicone oil film. Avoiding the use of silicone oil in a copier avoids the requirement of extra elaborate equipment in the copier and the additional expense to supply the silicone oil film to the fuser roll.

In accordance with the present invention it is preferred that a heated fuser roll be formed of a graphite cylinder. When a heated fuser roll is formed of a hollow graphite cylinder a radiant heater, such as for example an infrared lamp or a halogen lamp, can be centrally located within the cylinder to heat the roll. To provide a fuser roll which will exhibit (i) the necessary thermal conductivity properties of the graphite material and allow for sufficient heat from an internally located radiant heater to heat the roll surface to a temperature sufficiently high to provide the proper fusing conditions, and (ii) at the same time the necessary strength characteristics of the hollow cylinder so that the cylinder is strong enough to withstand the typical bending stresses that occur in a pressure fusing apparatus, a hollow graphite cylinder having a wall thickness ranging from about 0.125 inches to about 0.5 inches is eminently suited.

In order to provide a fusing roll having an optimum combination of mechanical properties, the fuser roll can be formed of a graphite material containing small amounts of carbon, e.g., amounts less than about 0.5% (percent) by weight of carbon. The addition of these small amounts of carbon to the graphite significantly increases the strength, hardness and wear resistance of the material. An example of a commercially available carbon containing graphite material which can be used for the heated fuser roll is a material sold under the trademark "UCAR" by the Union Carbide Corporation.

During operation of a typical heated pressure fusing apparatus employing a heated fuser roll formed of a graphite material in accordance with the present invention, the paper to which the toner images are electrostatically adhered is passed through the nip formed between two rolls, i.e. the graphite fuser roll and a pressure roll, with the toner image contacting the heated fuser roll to effect heating of the toner image within the nip. Fusing is enhanced by the second roll or pressure roll as it is commonly called as the result of a biasing force which forces the rolls into engagement. The pressure roll is typically constructed of a rigid core formed, for example, of aluminum having a relatively thick resilient layer affixed thereto and, if required, an outer layer or sleeve of a material which would exhibit a low affinity for tackified toner. The resilient layer can be formed of many materials known in the art such as a resilient heat resistant elastomeric material, e.g. silicone rubber, and the outer sleeve, for example, a thin coating of a tetrafluoroethylene material. Instead of using a pressure roll, it is also possible to employ in accordance with the present invention a resilient belt, e.g. a silicone rubber belt, as the pressure backup member for the graphite cylinder.

I claim:

1. In an electrostatic copying machine in which the fusing apparatus for fixing toner images to a support surface comprises a heated fuser member in pressure contact with a backup member, and fusing is accomplished by passing the support surface with the toner images thereon between the heated fuser member and backup member thereby applying heat and pressure to the toner image, an improved roll type fuser member whose outer surface comprises graphite, said graphite comprising less than about 0.5 percent by weight carbon.

2. A heated fuser roll according to claim 1 wherein said fuser roll is made of a hollow graphite cylinder.

3. A heated fuser roll according to claim 2 wherein said cylinder has a wall thickness ranging from about 0.125 inches to about 0.5 inches.

4. A heated fuser roll according to claim 2 wherein the outer surface of the fuser roll is heated by a heating means disposed internally within said graphite cylinder.

5. A heated fuser roll according to claim 2 wherein said backup member is deformable by said graphite cylinder.

6. A heated fuser roll according to claim 4 wherein said backup member is a roll structure comprising an outer surface of a silicone rubber.

7. A heated fuser roll according to claim 4 wherein said backup member is a roll structure comprising an outer surface of polytetrafluoroethylene.

8. A heated fuser roll according to claim 4 wherein said backup member is a resilient belt.

9. In an electrostatic copying machine in which the fusing apparatus for fixing toner images to a support surface comprises a heated fuser member in pressure contact with a backing member, and fusing is accomplished by passing the support surface with the toner images thereon between the heated fuser member and backup member thereby applying heat and pressure to the toner image, an improved roll type fuser member comprising a hollow cylinder whose wall thickness ranges from about 0.125 inches to about 0.5 inches, the cylinder being made of a material comprising graphite with less than about 0.5 percent by weight carbon.

* * * * *